US005262647A

United States Patent [19]

Kumada

[11] Patent Number: 5,262,647

[45] Date of Patent: Nov. 16, 1993

[54] INFRARED DETECTOR WITH PYROELECTRIC DETECTOR ELEMENT AND CHOPPER CONTROL CIRCUIT

[75] Inventor: Akira Kumada, Kanagawa, Japan

[73] Assignee: Murata Mfg. Co., Ltd., Kyoto, Japan

[21] Appl. No.: 962,439

[22] Filed: Oct. 16, 1992

[30] Foreign Application Priority Data

Oct. 21, 1991 [JP] Japan ..... 3-272840

[51] Int. Cl.[5] ..... G01J 5/62

[52] U.S. Cl. ..... 250/351; 250/338.3; 250/342

[58] Field of Search ..... 250/351, 338.3, 342

[56] References Cited

U.S. PATENT DOCUMENTS 4,825,075 4/1989 Jacoby et al. ..... 250/342

FOREIGN PATENT DOCUMENTS 1-124721 5/1989 Japan ..... 250/351

*Primary Examiner*—Carolyn E. Fields

*Attorney, Agent, or Firm*—Jordan and Hamburg

[57] ABSTRACT

An infrared detector with a pyroelectric detector element and an AC amplifier has a chopper control circuit that enables the detector to sense either a moving person or temperature. When used to sense a moving person, the chopper control circuit stops operation of the chopper, and the gain of the amplifier is increased. When used to sense temperature, the chopper is operational, the gain of the amplifier is decreased, and total infrared energy is measured.

4 Claims, 4 Drawing Sheets

PRIOR ART

INFRARED DETECTOR WITH PYROELECTRIC DETECTOR ELEMENT AND CHOPPER CONTROL CIRCUIT

BACKGROUND OF THE INVENTION

1. Field of the Invention

This invention relates to an infrared detector, and more particularly to an IR (infrared) detector which enables both detection of a moving person and detection of radiation temperature by using a single pyroelectric infrared detector element.

2. Description of the Prior Art

A pyroelectric infrared detector element is a thermal type of infrared detector element having the differential type of output characteristics, which has been used for various applications because of its features such as high sensitivity, availability under room temperature, and low cost. The representative applications include a detector for moving person and a detector for radiation temperature of a disaster preventing equipment and other industrial equipment.

FIG. 5 shows an example of conventional moving person detector.

This moving person detector 201 comprises a pyroelectric infrared detector element 1, an AC amplifier 30 which amplifies output from the pyroelectric infrared detector element 1 in AC mode, and a comparator 71 which compares output from the AC amplifier 30 to the prespecified reference value, and outputs a moving person detection signal when a person comes into a field of view of the pyroelectric infrared detector element 1.

In the moving person detector 201, the target for detection is only a change caused by movement of a person within the total infrared ray energy input to the pyroelectric infrared detector element 1. This change level is very weak, and accordingly a gain (amplification factor) of the AC amplifier 30 is required around 70 dB.

FIG. 6 shows an example of conventional radiation temperature detector.

This radiation temperature detector 202 comprises the pyroelectric infrared detector element 1, a chopper mechanism 2 for cyclically interrupting the infrared ray input to the pyroelectric infrared detector element 1, a chopper driving circuit 21 drives the chopper mechanism 2, an AC amplifier 40 which amplifies output from the pyroelectric infrared detector element 1 in AC mode, a sample/hold circuit 41 for synchronous detecting an output signal from the AC amplifier 40, a sampling signal generating circuit 42 which generates a sampling signal synchronized to the output signal from the chopper driving circuit 21 and gives the sampling signal to the sample/hold circuit 41, a temperature compensator 51 which generates a temperature compensating signal based on the temperature information detected by a temperature detecting element (not shown) provided adjacent to the chopper mechanism 2, and a DC amplifier 61 which generates a radiation temperature detection signal which is proportional to the infrared ray energy input to the pyroelectric infrared detector element 1; and outputs a radiation temperature detection signal which is proportional to intensity of the infrared ray energy radiated from an object within a field of view of the pyroelectric infrared detector element 1, namely radiation temperature of the object.

In a radiation temperature detector 202, the target for detection is the total infrared ray energy input to the pyroelectric infrared detector element 1. This is enabled by cyclically interrupting the infrared ray energy input to the pyroelectric infrared detector element 1 with the chopper mechanism 2. A level of this total infrared ray energy is relatively high, and the gain of the AC amplifier 40 is in a range from 30 to 40 dB.

In recent years, functions of electric houseware have been becoming more and more sophisticated because of introduction of microcomputers, and now incorporation of a detector for collecting various types of control information is required.

For instance, in air conditioners for home use, incorporation of a detector for moving person to collect information on movement of human bodies or a radiation temperature detector to collect information on temperature of a floor surface or a wall surface in a room is required.

However, if both the moving person detector 201 and the radiation temperature detector 202 are to be incorporated in one equipment, the configuration would become too complicated with the size becoming too large, and also the price would become too expensive.

SUMMARY OF THE INVENTION

An object of the invention is to provide an IR detector which enables both detection of moving person and detection of radiation temperature.

The IR detector according to the invention having a pyroelectric infrared detector element, a chopper mechanism which cyclically interrupts an infrared ray input to the pyroelectric infrared detector element, a chopper driving circuit which drives the chopper mechanism, and an AC amplifier which amplifies an output signal from the pyroelectric infrared detector element in AC mode; characterized in that said IR detector includes a chopper control circuit which controls start/stop of the chopper mechanism according to a control signal input from outside and a gain control circuit which changes the gain of the AC amplifier.

While a control signal to stop operation of the chopper mechanism is input, the chopper control circuit stops operation of the chopper mechanism. So, the pyroelectric infrared detector element outputs only a changed factor caused by movement of a person within the input infrared ray energy. The gain control circuit changes the gain of the AC amplifier so that an optimal value for amplification of the output will be provided. Thus, a function as a moving person detector is provided by this operation.

On the other hand, when a control signal to drive the chopper mechanism is provided, the input infrared ray is cyclically interrupted by the chopper mechanism. So, the pyroelectric infrared detector element outputs a total of the input infrared ray energy. The gain control circuit changes the gain of the AC amplifier so that an optimal value for amplification of the output will be obtained. Thus, a function as a radiation temperature detector is provided by this operation.

DESCRIPTION OF THE PREFERRED EMBODIMENTS

Detailed description of the invention will be made below with embodiments shown in the figures. However it should be noted that the invention is not limited to the embodiments.

Figure 1:
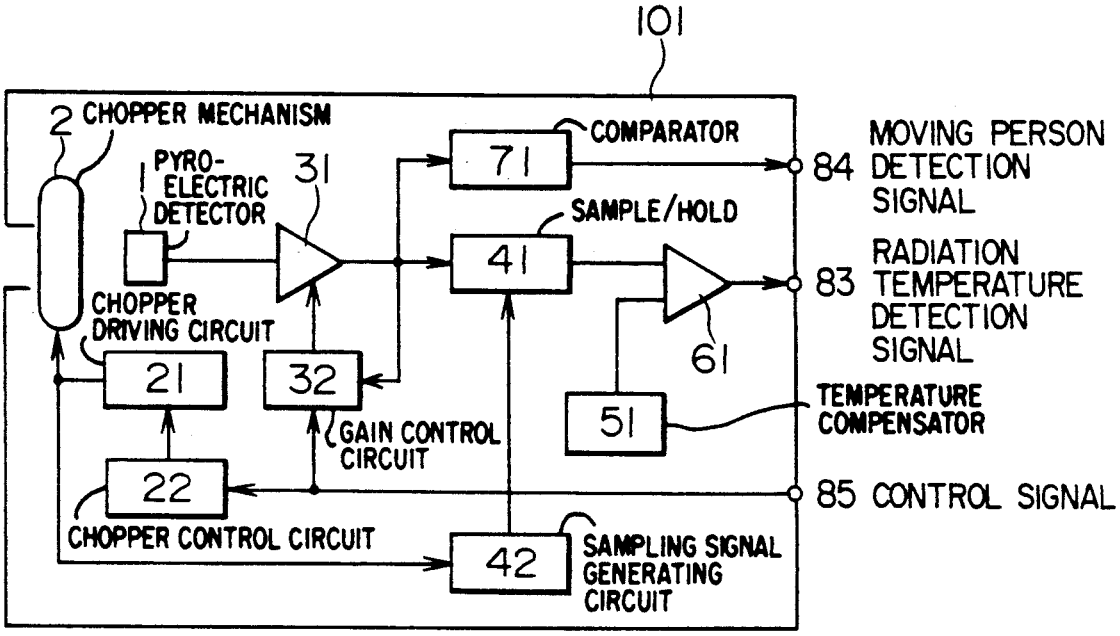
FIG. 1 is a block diagram of an IR detector according to an embodiment of the invention.

FIG. 1 shows a block diagram of an IR detector 101 according to an embodiment of the invention.

This IR detector 101 comprises a pyroelectric infrared detector element 1, a chopper mechanism 2, a chopper driving mechanism 21, a chopper control circuit 22 which controls operation of the chopper driving circuit 21, an AC amplifier 31 which amplifies output from the pyroelectric infrared detector element 1, a comparator 71, a gain control circuit 32 which changes a gain of the AC amplifier 31 according to output from the chopper control circuit 22, a sample/hold circuit 41, a sampling signal generating circuit 42, a temperature compensator 51, and a DC amplifier 61.

The chopper control circuit 22 starts operation of the chopper mechanism 21 if a control signal input to an input terminal 85 is "L", and stops operation of the chopper mechanism 21 in the open state if the control signal is "H".

Figure 2:
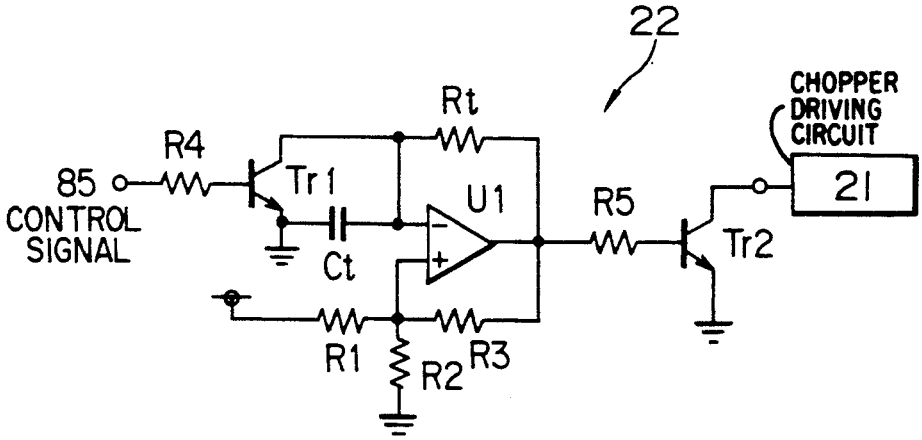
FIG. 2 shows an example of a chopper control circuit.

FIG. 2 shows an example of the chopper control circuit 22.

The chopper control circuit 22 comprises an operational amplifier U1, transistors Tr1 and Tr2, a capacitor Ct, a resistor Rt, and resistors R1 through R5.

While the control signal is "L", the operational amplifier U1, as a non-stable vibrator, carries out oscillation according to a frequency decided by the time constants for Ct and Rt and the threshold voltage decided by R1 through R3. This oscillation output is given via the R5 and Tr2 to the chopper driving circuit 21.

When the control signal is turned to "H", Tr1 turns on and stops charging of Ct. With this, oscillation is stopped and the oscillation output is not fed to the chopper driving circuit 21. For this reason, operation of the chopper driving circuit 21 is stopped, and the chopper mechanism 2, to which a bias force is given so that it is turned to an open state, is stopped in the open state.

The gain control circuit 32 reduces a gain of the AC amplifier 31 if the control signal input to a control input terminal 85 is "L", and increases the gain of the AC amplifier 31 if the control signal is "H".

Figure 3:
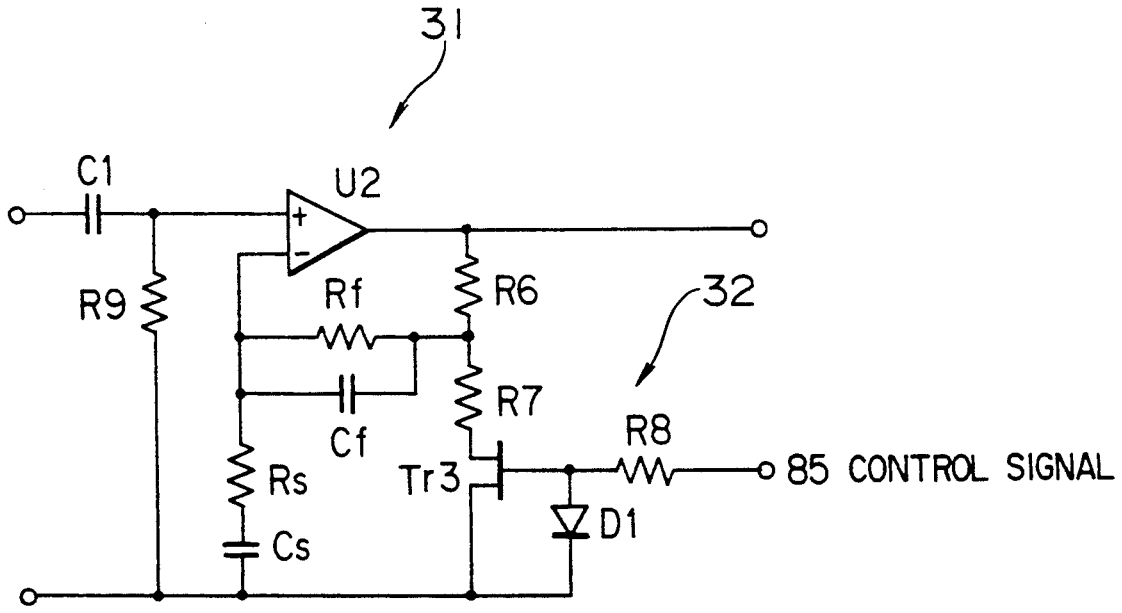
FIG. 3 shows examples of an AC amplifier and an gain control circuit.

FIG. 3 shows examples of the AC amplifier 31 and the gain control circuit 32.

A gain within a frequency band is decided by the Rs, Cs, Rf, Cf, R6, and R7. A transistor Tr3 is used as a bipolar switch.

While the control signal is "L", Tr3 is off, and the gain A is given by the following equation;

$$A = Zf/Zs$$

herein Zf is an impedance decided by Rf and Ct, while Zs is an impedance decided by Rs and Cs.

When the control signal is turned to "H", Tr3 is on, and the gain A is given by the following equation;

$$A = (Zf/Zs)(R6 + R7)/R3$$

So, the gain can be changed by approximately selecting R6 and R7.

Figure 4:
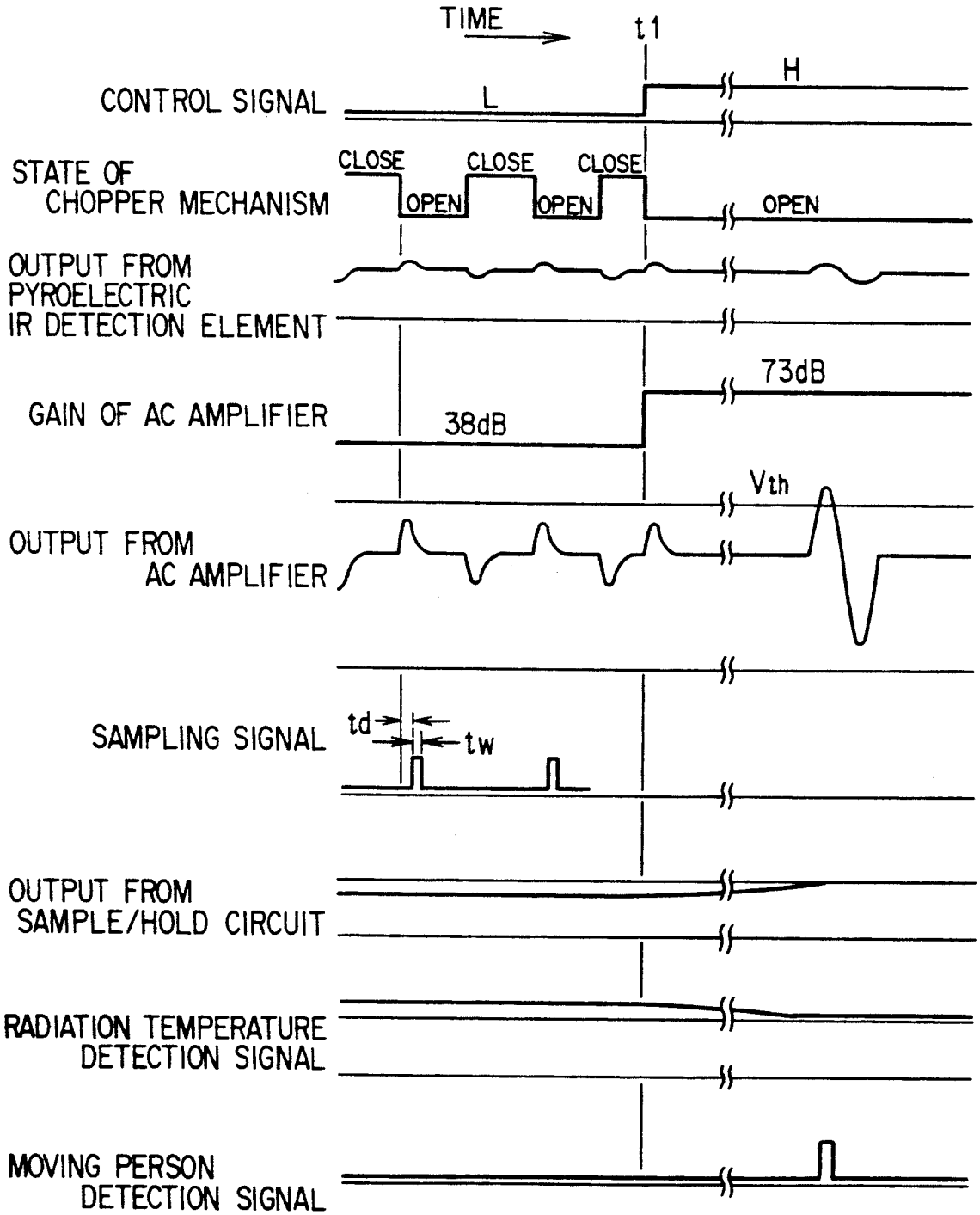
FIG. 4 is a signal diagram illustrating operation of the IR detector shown in FIG. 1.
Figure 5:
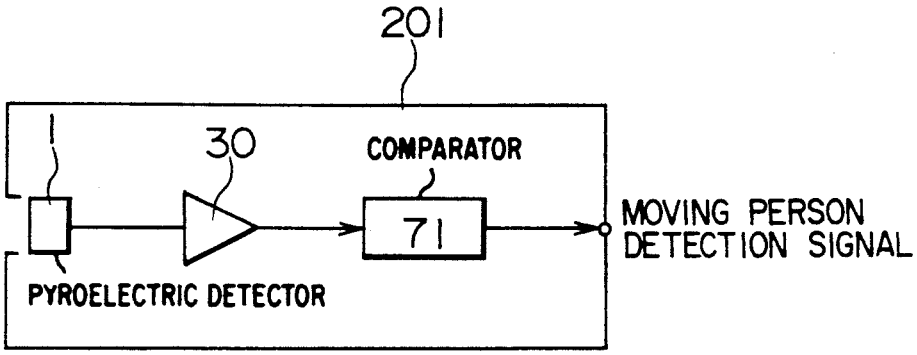
FIG. 5 is a block diagram of an example of a conventional moving person detector.
Figure 6:
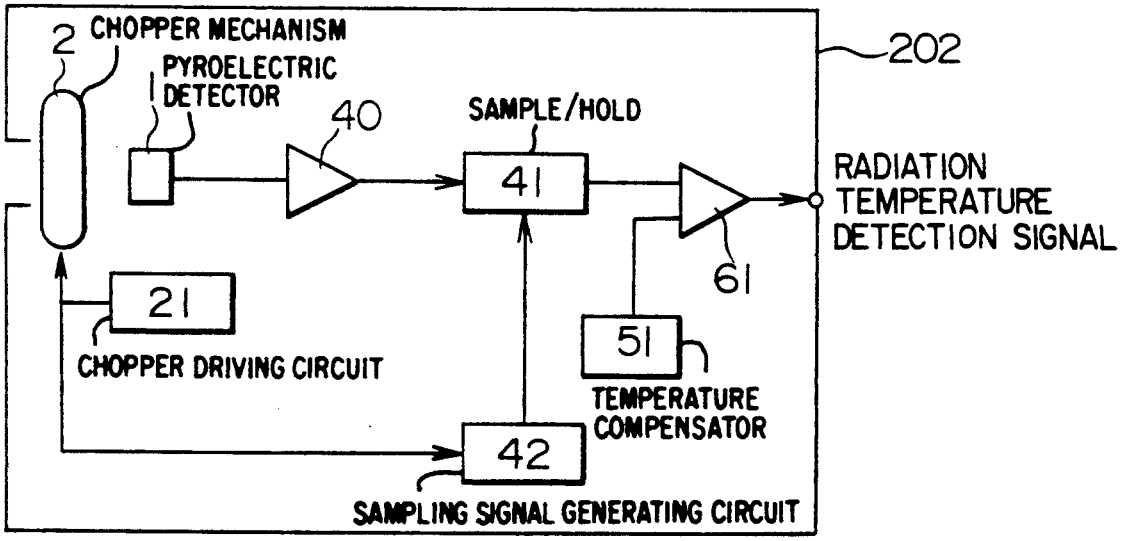
PRIOR ART FIG. 6
FIG. 6 is a block diagram of an example of a conventional radiation temperature detector.

Description is made below for the operations with reference to FIG. 4.

At first, operation up to time t1 is described.

The control signal is "L" until time t1, and the chopper mechanism 2 cyclically repeats the open state and the closed state. The operation frequency is, for instance, 1.5 Hz.

Output from the pyroelectric infrared detector element 1 is the one corresponding to a total of the input infrared ray energy.

The gain of the AC amplifier 31 is forcefully decreased to, for instance, 38 dB, because the control signal is "L".

So output from the AC amplifier 31 is obtained by amplifying output from the pyroelectric infrared detector element 1 with, for instance, 38 dB.

At this time, the sampling signal is a pulse with a width tw (for instance, 12 ms) at a timing of delayed time td (for instance, 200 ms) from switching from the open state to the closed state of the chopper mechanism 2.

And, output from the sample/hold circuit 41 is an output value from the AC amplifier 31 when the sampling signal is input.

A radiation temperature detection signal (namely, output from the DC amplifier 61) is a value obtained by compensating the output value from the sample/hold circuit 41 according to the temperature. This value is proportional to an average temperature of an object which exists in a field of view of the pyroelectric infrared detector element 1.

A moving person detection signal (namely, output from the comparator 71) is not generated, because the gain of the AC amplifier 31 has been reduced and output from the AC amplifier 31 does not exceed the reference value Vth.

Next, description is made for operation from time t1.

From time t1, the control signal is "H", and the chopper mechanism 2 is kept open state.

Output from the pyroelectric infrared detector element 1 is one which corresponds to a change of the input infrared ray.

As the control signal is "H", the gain of the AC amplifier 31 has been raised to, for instance, 73 dB.

So, output from the AC amplifier 31 is obtained by amplifying output from the pyroelectric infrared detector element 1 with, for instance, 73 dB.

At this time, the sampling signal is not provided.

Output from the sample/hold circuit 41 preserves the previous value.

The radiation temperature detection signal (namely, output from the DC amplifier 61) is a value obtained by compensating the output value from the sample/hold circuit 41 according to the temperature, but this value is meaningless herein.

A moving person detection signal (namely, output from the comparator 71) becomes a detection signal of moving human body, because the gain of the AC amplifier 31 has been raised and output from the AC amplifier provided when a person moves exceeds the reference value Vth.

With the IR detector element 101 as described above, it is possible to detect both movement of a person and radiation temperature by using a single unit of the pyroelectric infrared detector element 1. Thus, it is possible to realize a small size and low cost IR detector.

As another embodiment of the invention, the chopper control circuit 22 may be replaced one which comprises digital IC invertors and gates.

Also the gain control circuit 32 may be replaced one which changes the Rf value in FIG. 3.

Furthermore, detection of a moving person and detection of radiation temperature may be carried out by means of A/D conversion of output from the AC amplifier 31 and processing by a microcomputer.

With the infrared detector according to the invention, a moving person detector and a radiation temperature detector can be unified in a single unit. Also minimization of a detector and cost reduction are possible.

What we claimed is;

1. An IR detector having a pyroelectric infrared detector element, a chopper mechanism which cyclically interrupts an infrared ray input to the pyroelectric infrared detector element, a chopper driving circuit which drives the chopper mechanism, and an AC amplifier which amplifies an output signal from the pyroelectric infrared detector element in AC mode; characterized in that the IR detector includes a chopper control circuit which controls operation/stop of the chopper mechanism according to a control signal and a gain control circuit which changes a gain of the AC amplifier according to the control signal.

2. The IR detector of claim 1 wherein the gain control circuit decreases the gain of the AC amplifier when the control signal by which the chopper control circuit makes the chopper mechanism operate is input and increases the gain of the AC amplifier when the control signal by which the chopper control circuit makes the chopper mechanism stop is input.

3. The IR detector of claim 2 wherein the chopper control circuit comprises an oscillator which starts and stops oscillation according to the control signal.

4. The IR detector of claim 1 wherein the control signal is input from outside of the IR detector.

* * * * *